United States Patent [19]

Serota et al.

[11] 4,152,198

[45] May 1, 1979

[54] ISOPROPENYL ESTER SIZED PAPER AND METHOD FOR PRODUCING SAME

[75] Inventors: Samuel Serota; Leonard S. Silbert, both of Philadelphia; Gerhard Maeker, Oreland, all of Pa.

[73] Assignee: The United States of America as represented by the Secretary of Agriculture, Washington, D.C.

[21] Appl. No.: 878,041

[22] Filed: Feb. 15, 1978

[51] Int. Cl.[2] ..... D21F 11/00

[52] U.S. Cl. ..... 162/128; 162/132; 162/135; 162/136; 162/158; 427/395; 428/453; 428/537

[58] Field of Search ..... 162/158, 179, 183, 135, 162/136, 184, 128, 132, 127; 8/116 R; 427/395; 106/243; 428/537, 449, 453; 156/314, 326

[56] References Cited

U.S. PATENT DOCUMENTS

| | | | |
|---|---|---|---|
| 2,785,995 | 3/1957 | Kress | 162/182 |
| 4,067,688 | 1/1978 | Payet | 8/116 R |

FOREIGN PATENT DOCUMENTS

| | | | |
|---|---|---|---|
| 47-8163 | 3/1972 | Japan | 162/184 |
| 503971 | 3/1976 | U.S.S.R. | 162/158 |

OTHER PUBLICATIONS

Casey "Pulp & Paper", vol. III (1960), pp. 1866, 1867.

*Primary Examiner*—S. Leon Bashore
*Assistant Examiner*—Peter Chin
*Attorney, Agent, or Firm*—M. Howard Silverstein; William E. Scott; David G. McConnell

[57] ABSTRACT

Paper and paperboard made of felted cellulose fibers are chemically modified by applying to them an isopropenyl ester containing a catalytic amount of an acid catalyst and then heat curing the treated product. The process imparts water repellancy to the paper products with a very low degree of add-on, but with a very high degree of retention of tensile strength. The products also have excellent printability, are resistant to boiling water, and retain their opacity after exposure to water.

14 Claims, No Drawings

ISOPROPENYL ESTER SIZED PAPER AND METHOD FOR PRODUCING SAME

BACKGROUND OF THE INVENTION

1. Field of the Invention

This invention relates to the chemical modification of paper and paperboard made of felted cellulose fibers to impart to the paper the property of water repellancy with a very low degree of substitution and without significantly altering the tensile strength of the treated product.

2. Description of the Prior Art

In the treatment or sizing of paper to improve the properties of the paper, it is conventional and well-known to add a sizing agent, such as, rosin, wax, asphaltic material and the like to the pulp slurry before the sheet is formed. Other agents, such as organic ketene dimers are also used, mostly in the internal sizing process. This art is found in a number of U.S. and foreign patents, namely, U.S. Pat. Nos. 2,865,743; 3,130,118; 2,961,366; 2,986,488; 2,961,367; 3,046,186; 3,524,796; 3,070,452; 2,762,270; 2,785,067; 2,627,477; 3,212,961; 3,223,544; 3,006,806; Canadian Patents 611,247; 688,272; 567,352; 816,411; 846,762; and British Patents 802,356; 802,357; and 985,028. In addition, a good discussion of the art is found in Fiber Science Series, Volume 4, "Chemical Modification of Papermaking Fibers" by Kyle Ward, Jr., Institute of Paper Chemistry, Published by Marcel Dekker, Inc., N.Y., 1973.

BRIEF SUMMARY OF THE INVENTION

An object of this invention is to provide a means of treating paper and paperboard made of felted cellulose fibers to make such products water repellant.

A further object is to make such paper and paperboard products water repellant with a very low degree of substitution or add-on while retaining a high degree of tensile strength.

A still further object is to make the water repellancy of such products resistant to the action of boiling water.

Another object is to provide paper products that are water repellant with a low degree of substitution, that retain a high degree of their original tensile strength, that have excellent printability, and that retain their opacity after exposure to water.

According to this invention, the above objects are accomplished by a process wherein an isopropenyl ester containing a catalytic amount of an acid catalyst is applied to paper and paperboard made of felted cellulose fibers and then the so-treated paper or paperboard is cured. The paper and paperboard of this invention are water repellant, have a very low degree of fatty moiety added-on, have retained a very high degree of their original tensile strength, retain their opacity after exposure to water, and are resistant to the action of boiling water.

DETAILED DESCRIPTION OF THE INVENTION

In addition to the desirable properties of water repellancy, low degree of add-on, and retention of tensile strength, the paper treated by the process of this invention also possesses the desirable properties of flexibility and nonslipperiness. Consequently, the papers produced by the instant process are especially useful in the wrapping and containment of meat, fish, poultry, vegetables, construction materials such as cement, lime and the like, chemicals, and in the manufacture of sodium silicate-laminated liner board for air dried fiber shipping containers.

Water repellancy of paper modified by the process of this invention was determined by three standard procedures: first, the water drop penetration test; a drop of water weighing approximately 65 mg. is allowed to fall upon one side of the treated paper which is then observed to determine the amount of water absorbed. The same test is applied to the other side of the paper. On untreated paper, the water was absorbed immediately. On paper treated by the process of our invention, the water drop, upon impact, was subdivided into numerous spherical droplets which were not absorbed by the paper. Second, the sessile drop appearance test; approximately 1/20 c.c. sessile drop of distilled water is allowed to contact the sized paper from a syringe. Viewed from the side, an unabsorbed water droplet appears more globular than elliptical after three hours in an equilibrated sealed jar. Third, the submersion test; samples are submerged in distilled water in a sealed jar for varying periods of time to determine water repellancy and other properties. Paper treated by the process of our invention exhibited excellent water repellancy. It also displayed an unusual retention of opacity, even when creased, after a three hour submergence, in addition to retaining its original appearance and flexibility. This is in sharp contrast with papers that are heavily sized with conventional materials such as resins, paraffins and stearic acid which undergo a substantial loss of opacity after only several minutes submergence, especially when folded or when pressure is applied.

Tensile strengths were determined by a modified ASTM Test Method D-1682-64 (70) on an Instrom Tester Model TT-B.

The enol ester can be applied to the cellulosic textile in solution or neat. Neat application may be as a liquid melt containing at least a catalytic amount of p-toluenesulfonic acid monohydrate (PTSA) or other catalyst or as a powder. A powder is prepared by allowing the melt of ester and catalyst to solidify after which the solid is crushed to powder. Applied neat, that is, as a liquid melt or as a powder containing at least a catalytic amount of PTSA or other catalyst, the amount of ester may vary widely, yet the process consistently affords an esterified product with a low degree of substitution. The amount of ester may vary from 0.01 mole of isopropenyl ester to 0.1 mole or more per mole of anhydroglucose. The amount of PTSA may also vary, but the preferred mole ratio of PTSA to isopropenyl ester is about $8.5\times10^{-4}$:1.

Any solvent which has good solubilizing action for both the isopropenyl ester and the catalyst, which is stable toward acylation by the isopropenyl ester and toward deterioration by acid catalysts, which has the proper volatility, and which is inert toward the paper being treated is suitable.

Although in most instances a low degree of substitution is desirable, higher degrees of substitution can be obtained by applying te enol ester-catalyst reagent in solution.

The rapidity of the reaction and the very small degree of add-on that confers the useful property of water repellancy while retaining essentially all of the original tensile strength of the paper material was totally unexpected. Also wholly unexpected was the fact that the water repellancy imparted to the paper was resistant to boiling water. Even more unexpected was the anti-slipperiness of the paper products treated by the process of this invention. Actually, one knowledgeable in the art would predict that the coefficient of sliding would decrease because of the add-on of fatty moiety.

In the practice of this invention, any long chain fatty isopropenyl ester in which the fatty moiety contains from 8 to 22 carbon atoms can be used in the process of this invention including the octanoate, palmitate, oleate, stearate, either singly or in combination.

In order to be suitable for this process, the acid catalyst must be able to catalyze the isopropenyl ester acylation of the paper product without adversely affecting the physical properties of the latter. The preferred catalyst for the process of this invention is PTSA. Other catalysts that were found suitable are β-naphthalenesulfonic acid and partially dehydrated phosphoric acid.

The fibrous cellulosic textile material is acylated in our process under mild conditions with a very small amount of add-on to render the fabric water repellant. The water repellancy achieved by this process is permanent and is not removed by dry cleaning or other exposure to organic solvents such as perchlorethylene, Stoddard solvent, skellysolve, benzene, or other neutral solvents even though the paper is completely wetted by these solvents.

In practicing the invention, the paper product is treated with an effective sizing amount of an isopropenyl ester having mixed therein a catalytic amount of an acid catalyst. The paper product is coated, padded, sprayed, or impregnated by immersion or other way with a solution or with the neat liquid melt or powder of ester containing catalyst. The paper product is then heated for from about one-tenth of a second to about fifteen seconds at temperatures between 130° C. and about 350° C. The heating may be accomplished with a flat iron, rollers, microwave, infrared lamps, or an oven. Oven curing is accomplished by pinning the wetted material to a wooden frame, air drying the material, and then heating it in an oven for the prescribed period. The treated material may then be extracted to remove unreacted ester and catalyst if desirable.

In the following examples in which the invention is illustrated, the same type paper, a medium fast filter paper which is pure alpha-cellulose having a basis weight of 90 gms. per square meter, was used in all experiments. This paper is known as Whatman filter paper No. 1. The paper was air-equilibrated before use.

EXAMPLE 1

Air-equilibrated paper as described above was placed on a Pyroceram plate which was resting on insulating pads. Pyroceram is a ceramic material with a very low coefficient of expansion. Any like material is suitable for the purposes of this invention. To 100 gms (0.31 mole) of melted isopropenyl stearate was added 50 mg. (0.00025 mole) of PTSA and the mixture swirled on a hot plate at about 100° C. until a single phase formed. The filter paper was cmpletely covered with the poured melt. An electric iron was used to cure the filter paper at 185° C. Unreacted material was extracted from the treated paper in a Soxhlet extractor with methylene chloride and the sized papers subsequently analyzed for physical and chemical properties. Any other suitable solvent such as diethyl ether may be used to extract the unreacted material.

The degree of substitution and the amount of stearoyl moiety in the anhydroglucose structure of the paper was determined by a new, simple, sensitive, inexpensive chemical analysis whereby the soap solution from the saponified paper was neutralized and the liberated fatty acids were isolated using a Celite column. Saponification was carried out as follows: A weighed sample of the treated (sized) paper was submerged in IN n-propanolic potassium hydroxide for 2 hours at 95° C. Alternatively, saponification may be carried out in IN methanolic potassium hydroxide in a sealed flask at 65° C. for 5 hours. The Celite column was prepared as follows: Celite was washed with 0.IN hydrochloric acid followed by water, then acetone and finally dried in an oven. The Celite was intimately mixed with phosphoric acid and placed inside a short glass tube. An aliquot of the propanolic solution containing potassium stearate from the partial cellulose stearate was placed on the tube, and eluted with petroleum ether to afford stearic acid. An aliquot was quantitatively measured by gas-liquid chromatography using an 8′×¼″SS column packed with ethylene glycol adipate and phosphoric acid on about 100 mesh Anachrome ABS at 220° C. A helium flow rate of 30 cc per minute was employed.

Sized paper made in accordance with this invention also presented a very receptive surface for printing ink. Good resistance to feathering was secured with as little as 0.20 percent add-on which is equivalent to a degree of substitution of 0.001. This means that on the average, about one hydrogen of every three thousand hydroxyl groups present was replaced by an acyl moiety such as the stearate.

The water repellancy and tensile strengths of the paper treated as above and extracted four hours with $CH_2Cl_2$ are shown in Table 1.

Table 1

| Curing[1] Time Seconds | Water Repellancy[3] | Tensile Strength lbs./sq. in. |
|---|---|---|
| Control[2] | None | 1265 |
| 4 | Excellent | 1175 |
| 8 | Excellent | 1245 |
| 12 | Excellent | 1195 |

[1]Average of 9 specimens per sample, all samples heat cured at 185° C.
[2]Virgin paper, no treatment.
[3]By three tests previously described.

EXAMPLE 2

Paper was treated as in Example 1 except that curing time on each side of the paper was 10 seconds at 185° C. and the mole ratio of isopropenyl stearate to PTSA of sample A was 1:0.001 while that of sample B was 1:0.01. The treated papers were extracted 16 hours in a Soxhlet extractor with $CH_2Cl_2$. The results are shown in Table 2.

Table 2

| Sample | Tensile Strength | Water Repellancy[2] | Water Repellancy[3] |
|---|---|---|---|
| Control[1] | 1160 | absorbed immediately | absorbed immediately |
| A | 870 | numerous unabsorbed globules | non-absorbed, partial water film on surface |
| B | 625 | numerous unabsorbed globules | non-absorbed, partial water film on surface |

[1]Virgin paper, no treatment.
[2]By water drop penetration test.
[3]3.5 hours submergence.

The results shown in Table 2 demonstrate that effective results can be obtained by use of PTSA over a large range of concentrations. The lowest concentration consistent with desired sizing is preferred.

EXAMPLE 3

Paper was immersed for 15 minutes in 200 ml. of benzene containing 50.0 mg. of PTSA and 10.0 gm. of isopropenyl stearate (mole ratio of 0.0081:1.0) in a sealed jar and the mixture shaken for one minute after which the treated paper was air dried in a hood. The air dried paper was then heat cured with an iron at 190° C. for 15 seconds. The paper was extracted in a Soxhlet extractor with $CH_2Cl_2$ until excess reagent was removed. The results are shown in Table 3.

Table 3

| Sample | Water Repellancy[2] | Tensile Strength[3] lbs./sq.in. |
|---|---|---|
| Control[1] | None | 830 |
| Treated paper | Excellent | 520 |

[1]Virgin paper, no treatment.
[2]Average of 4 specimens, 3 tests previously described.
[3]Average of 4 specimens.

EXAMPLE 4

To 10.0 g. (0.031 mole) of melted isopropenyl stearate was added 0.050 g. (0.0025 mole) of PTSA and the mixture swirled until a solution formed. Upon cooling to about room temperature (20°-24° C.) the slution became solid. The solid was powdered and a sufficient amount of the powder was sprinkled on paper strips so that, upon ironing, as in Example 1, at 160° C. for 15 seconds the paper was completely covered with the melt of the powder. The treated paper was then extracted with $CH_2Cl_2$ for 4 hours and equilibrated at 50% RH and 23° C. Water repellancy and tensile strength are shown in Table 4.

Table 4

| Sample | Water Repellancy | Tensile Strength lbs./sq.in. |
|---|---|---|
| Control | None | 390 |
| Treated paper | Excellent | 475 |

EXAMPLE 5

Paper was treated with a melt of isopropenyl stearate-PTSA containing 0.05% W/W PTSA and cured at 180° C. for three different lengths of time. The average of 9 specimens per sample is shown in Table 5.

Table 5

| Sample | Curing Time sec. | Tensile Strength lbs./sq.in. | Water Repellancy[1] |
|---|---|---|---|
| control | 0 | 1265 | none |
| A | 4 | 1175 | Excellent |
| B | 8 | 1245 | Excellent |
| C | 12 | 1195 | Excellent |

[1]The following test was used for this example: an approximately 50 mg. drop of water was allowed to fall from a height of 2' on to paper resting upon a glass plate. The paper was then covered by an inverted exaporating dish the peripheral edge of which was sealed to the glass plate with wax. No absorption of water globules was noted for at least 1200 seconds on the sized papers.

EXAMPLE 6

Five ply laminates were prepared as follows: five papers were treated with a liquid melt of isopropenyl stearate - PTSA (0.05% W/W PTSA), heat cured for 8 seconds at 190° C. and extracted with $CH_2Cl_2$ for 4 hours. Two of the so-treated papers were dipped into sodium silicate (41° Baume at 21°-23° C.) The pick up of sodium silicate was 55%. A five layer laminate was prepared by sandwiching the two sodium silicate treated papers between papers not treated with sodium silicate and squeezing them together in a press. The laminates were dried in an oven at 90° C. for 50 minutes and then tested for water resistance by submersion in a sealed jar of water at 21° C. The laminate absorbed 8% water in 15 minutes and 15% water in 45 minutes. The water repellancy of the laminates prepared as above was much superior to that of any surfaced sized laminates known in the art. A 5-ply laminate of un sized paperboard became water-logged before 45 minutes and delaminated completely under the test described above. In these experiments the sodium silicate acted as an adhesive to bind the sheets together.

EXAMPLE 7

Seven ply laminates were prepared from unsized paper and from sized paper as in Example 6 and using the same sodium silicate. The laminates were suspended above water in sealed jars and exposed to the vapors for 72 hours at 20° C. The unsized laminate absorbed water and delaminated completely. The sized laminate held together and retained good rigidity except for the two outer plies which started to delaminate.

EXAMPLE 8

The sizing on paper treated by the process of this invention, that is, treated with a liquid melt of isopropenyl stearate-PTSA (0.05% W/W PTSA) and heat cured at 180° C. for 8 seconds, was tested by dipping some strips of the paper in blue-black ink for 15 seconds and other strips for 1200 seconds. The strips were rinsed in running water and then air dried. The degree of sizing was measured against the color of the strip of paper. An evenly distributed light blue color indicated excellent sizing; a dark color represented poor sizing. The results are shown in Table 6.

TABLE 6

| Time of Immersion in Ink | Color After Drying | |
|---|---|---|
| Seconds | Control | Sized |
| 15 | Dark Blue | Trace of Blue |
| 15 | Dark Blue | Trace of Blue |
| 15 | Dark Blue | Trace of Blue |
| 1200 | Very Dark Blue | Light Blue |
| 1200 | Very Dark Blue | Light Blue |
| 1200 | Very Dark Blue | Light Blue |

When the sized paper, after testing it as per this example, was split at the thickness, the paper inside was white on both surfaces. The unsized paper was colored the same throughout the thickness.

The sizing of the papers from Example 8 was also tested by writing on them with a quill pen using blue-black ink. On the sized paper, the lines were sharp and free of feathering. On unsized paper, the lines exhibited marked feathering.

EXAMPLE 9

The coefficient of sliding friction of papers sized by the process of this invention (as described in Example 8) was compared with that of unsized paper. It was found that both the sized paper and the unsized paper had a coefficient of sliding friction of 0.90. This demonstrates that this property is retained under the conditions of treatment in the process of this invention. This is in contrast with ketene dimer sized paper which does not retain the coefficient of sliding friction of the unsized paper.

EXAMPLE 10

The effect of boiling water on pape sized by the process of this invention, that is, treatment of paper with a melt of isopropenyl stearate-PTSA, (0.05% W/W PTSA), heat curing the paper for 8 seconds at 180° C., and extracting the cured paper for 16 hours with ethyl ether, was investigated. Paper so-sized was submerged in boiling water for 1200 seconds but was not wetted. On removal from the boiling water the paper was shaken free of superfluous water and a few seconds later it looked like and felt like dry virgin paper. In view of the fact that ketene dimer sized paper is wetted by hot liquids, this result was very surprising and totally unexpected.

For the purpose of this invention, curing temperatures may range from 130° C. to 250° C. However, the preferred range is from 170° C. to 210° C., while temperatures between about 180° C. and about 190° C. are most preferable. The preferred mole ratio of catalyst to enol ester is about $8.5\times10^{-4}$:1.0. However, this mole ratio can vary widely from about $8.1\times10^{-3}$:1.0 to about $8.1\times10^{-5}$:1.0.

We claim:

1. A process for chemically modifying paper and paperboard made of felted cellulose fibers comprising applying to said paper and paperboard an effective sizing amount of a long chain fatty isopropenyl ester having mixed therein a catalytic amount of an acid catalyst and then heat curing the treated paper product, said process imparting the property of water repellancy to said paper products at a very low degree of substitution and with a high degree of retention of tensile strength, and said treated paper having the additional property of being resistant to boiling water.

2. The process of claim 1 in which the isopropenyl ester is isopropenyl stearate.

3. The process of claim 2 in which the acid catalyst is p-toluenesulfonic acid monohydrate.

4. The process of claim 3 in which the mole ratio of p-toluenesulfonic acid monohydrate to ester is about 0.00081:1.0.

5. The process of claim 4 in which the ester-p-toluenesulfonic acid monohydrate is applied neat as a liquid melt.

6. The process of claim 4 in which the ester-p-toluenesulfonic acid monohydrate is applied neat as a powder.

7. The process of claim 4 in which the ester-p-toluenesulfonic acid monohydrate is aplied as a solution.

8. The product of the process of claim 1.

9. A process of preparing laminated paperboard comprising applying solium silicate to the product of claim 8 and sandwiching said sodium slicate treated paper between paper products of claim 8 and pressing them together with an effective laminating force.

10. The product of the process of claim 9.

11. A process for chemically modifying paper and paperboard made of felted cellulose fibers comprising applying to said paper an effective sizing amount of an isopropenyl ester having mixed therein a catalytic amount of an acid catalyst, said ester having a fatty moiety containing from 8 to 22 carbon atoms, and curing the treated paper by heating it at an effective curing temperature for up to about fifteen seconds, said process being effective to impart water repellancy to the paper at a low degree of substitution and with a high degree of retention of tensile strength.

12. The process of claim 11 in which the isopropenyl ester is isopropenyl stearate, the acid catalyst is p-toluenesulfonic acid monohydrate, the ester catalyst mixture contains from about 0.005 to about 0.05%, w/w, of PTSA, and the treated paper is cured at from about 180° C. to 190° C. for up to 15 seconds.

13. The process of claim 12 wherein the ester-catalyst mixture contains about 0.05% p-toluenesulfonic acid monohydrate, and the curing time is 8 seconds.

14. The product of the process of claim 13.

* * * * *